US009202406B2

(12) United States Patent
Inada

(10) Patent No.: US 9,202,406 B2
(45) Date of Patent: Dec. 1, 2015

(54) LIQUID CRYSTAL DISPLAY, DISPLAY METHOD, PROGRAM, AND RECORDING MEDIUM

(75) Inventor: Ken Inada, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 719 days.

(21) Appl. No.: 13/638,233

(22) PCT Filed: Mar. 31, 2011

(86) PCT No.: PCT/JP2011/058329
§ 371 (c)(1),
(2), (4) Date: Sep. 28, 2012

(87) PCT Pub. No.: WO2011/125899
PCT Pub. Date: Oct. 13, 2011

(65) Prior Publication Data

US 2013/0021390 A1 Jan. 24, 2013

(30) Foreign Application Priority Data

Apr. 2, 2010 (JP) ..... 2010-086445

(51) Int. Cl.
*G09G 3/20* (2006.01)
*G09G 3/36* (2006.01)

(52) U.S. Cl.
CPC ..... *G09G 3/2022* (2013.01); *G09G 3/3648* (2013.01); *G09G 2300/0447* (2013.01); *G09G 2320/0276* (2013.01)

(58) Field of Classification Search
CPC ..... G09G 3/2022; G09G 3/3648; G09G 2300/0447; G09G 2320/0276
See application file for complete search history.

(56) References Cited

U.S. PATENT DOCUMENTS

| | | | | |
|---|---|---|---|---|
| 7,965,268 | B2 | 6/2011 | Gass et al. | |
| 2004/0239698 | A1* | 12/2004 | Kamada | G09G 3/3607 715/714 |
| 2007/0013633 | A1* | 1/2007 | Kamada | G02F 1/1362 345/98 |
| 2008/0024409 | A1* | 1/2008 | Tomizawa | G09G 3/3648 345/88 |
| 2008/0129762 | A1* | 6/2008 | Shiomi | G09G 3/3648 345/690 |

(Continued)

FOREIGN PATENT DOCUMENTS

| | | | |
|---|---|---|---|
| JP | 2007-017988 | A | 1/2007 |
| JP | 2008-275853 | A | 11/2008 |
| JP | 2008-283578 | A | 11/2008 |
| JP | 2009-064025 | A | 3/2009 |
| JP | 2009-222942 | A | 10/2009 |
| JP | 2009-222943 | A | 10/2009 |

OTHER PUBLICATIONS

An International Search Report, dated Jul. 5, 2011 in International Application No. PCT/JP2011/058329.

*Primary Examiner* — Claire X Pappas
*Assistant Examiner* — Robert Stone
(74) *Attorney, Agent, or Firm* — Hauptman Ham, LLP

(57) ABSTRACT

An LCD device includes: an LC panel which exhibits different gamma curves under different view angles, and a display control circuit which divides a single frame period into first and second display periods and divides a display region of the LC panel into first and second regions. The display control circuit has a luminance computing section which computes A to D so that A to D satisfies A+C=B+D and A≠B≠D as well as C≠B≠D, where A and C are gray-level luminances, A and B are the white luminances of pixel data displayed in the first and second regions, respectively, during the first display period, and C and D are the white luminances of pixel data displayed in the first and second regions, respectively, during the second display period.

10 Claims, 11 Drawing Sheets

(56) References Cited

U.S. PATENT DOCUMENTS

2009/0153454 A1* 6/2009 Irie ..... G09G 3/3648 345/89

2009/0243971 A1* 10/2009 Uehara ..... G02F 1/1323 345/32

2010/0097409 A1* 4/2010 Miyasaka ..... G02F 1/1323 345/690

* cited by examiner

FIG. 9

(a) First Region

Pixel Data During First Display Period

| | |
|---|---|
| 189 | 189 |
| 189 | 189 |

Pixel Data During Second Display Period

| | |
|---|---|
| 189 | 189 |
| 189 | 189 |

Pixel Data During Total Of First And Second Display Periods

| | |
|---|---|
| 189 | 189 |
| 189 | 189 |

Luminance Factor During Square Viewing

| | |
|---|---|
| 50% | 50% |
| 50% | 50% |

Average Luminance Factor = 50%

Luminance Factor During Oblique Viewing

| | |
|---|---|
| 39% | 39% |
| 39% | 39% |

Average Luminance Factor = 39%

(b) Second Region

Pixel Data During First Display Period

| | |
|---|---|
| 255 | 255 |
| 255 | 255 |

Pixel Data During Second Display Period

| | |
|---|---|
| 0 | 0 |
| 0 | 0 |

Pixel Data During Total Of First And Second Display Periods

| | |
|---|---|
| 189 | 189 |
| 189 | 189 |

Luminance Factor During Square Viewing

| | |
|---|---|
| 50% | 50% |
| 50% | 50% |

Average Luminance Factor = 50%

Luminance Factor During Oblique Viewing

| | |
|---|---|
| 20% | 20% |
| 20% | 20% |

Average Luminance Factor = 20%

FIG. 11

(a) First Region

Pixel Data

| | |
|---|---|
| 189 | 189 |
| 189 | 189 |

Luminance Factor During Square Viewing

| | |
|---|---|
| 50% | 50% |
| 50% | 50% |

Average Luminance Factor = 50%

Luminance Factor During Oblique Viewing

| | |
|---|---|
| 39% | 39% |
| 39% | 39% |

Average Luminance Factor = 39%

(b) Second Region

Pixel Data

| | |
|---|---|
| 0 | 255 |
| 255 | 0 |

Luminance Factor During Square Viewing

| | |
|---|---|
| 0% | 100% |
| 100% | 0% |

Average Luminance Factor = 50%

Luminance Factor During Oblique Viewing

| | |
|---|---|
| 0% | 40% |
| 40% | 0% |

Average Luminance Factor = 20%

LIQUID CRYSTAL DISPLAY, DISPLAY METHOD, PROGRAM, AND RECORDING MEDIUM

RELATED APPLICATIONS

This application is a National Phase of International Application No. PCT/JP2011/058329, filed Mar. 31, 2011 and claims benefit from Japanese Patent Application No. 2010-086445, filed Apr. 2, 2010.

TECHNICAL FIELD

The present invention relates to a liquid crystal display device, a display method, a program, and a recording medium for displaying an image in accordance a viewing angle.

BACKGROUND ART

Liquid crystal display devices have the advantage of being thin in thickness, light in weight, and low in power consumption among various display devices, and have recently been widely used in various fields such as TVs (televisions), monitors, and portable terminals instead of CRTs (cathode-ray tubes).

Conventionally, in order to protect privacy during use of portable terminals such as cellular phones, various anti-peeking techniques have been proposed. One of them is a technique that utilizes the viewing angle characteristics of liquid crystals.

(a) of FIG. 10 is a diagram showing a γ (gamma) characteristic of a typical VA (vertical alignment) liquid crystal panel, and (b) of FIG. 10 is a diagram showing a gamma characteristic obtained by using a multi-gamma technique.

In (a) of FIG. 10, γ11 indicates a gamma curve obtained when the liquid crystal panel is looked squarely at, and γ12 indicates a gamma curve obtained when the liquid crystal panel is looked obliquely at.

Further, in (b) of FIG. 10, γ13 indicates a gamma curve obtained when the liquid crystal panel is divided into first and second regions and the first and second regions are looked squarely at, and γ14 indicates a gamma curve obtained when the first region is looked obliquely at, and γ15 indicates a gamma curve obtained when the second region is looked obliquely at.

It should be noted that looking squarely or obliquely at the liquid crystal panel means looking squarely or obliquely at a display screen of the liquid crystal panel. Further, in the following description, the term "during square viewing" refers to the time when the liquid crystal panel is looked squarely at, and the term "during oblique viewing" refers to the time when the liquid crystal panel is looked obliquelyat.

As shown in (a) of FIG. 10, a typical VA liquid crystal display device shows a phenomenon (excess brightness) of a gray level becoming higher in luminance when looked obliquely at.

That is why there is a technique (multi-gamma) for adjusting luminance in adjacent pixels to reduce excess brightness. Conventionally, a technique for effecting privacy by applying the multi-gamma technique has been known.

The technique is a technique for, with the liquid crystal panel having its display region divided into first and second regions, applying a normal gamma voltage to the first region and applying a multi-gamma voltage to the second region.

According to the technique, as shown in (a) of FIG. 10, the first region and the second region are substantially equal in luminance to each other when the liquid crystal panel is looked squarely at, but differ in luminance from each other when the light crystal panel is looked obliquely at. Therefore, privacy is effected by utilizing a phenomenon of a checkered pattern appearing when the liquid crystal panel is looked obliquely at and making it hard to see characters, etc. that are displayed in the first region when the liquid crystal panel is looked squarely at.

Patent Literature 1 discloses a technique for preventing peeking by applying the foregoing technique to display, during oblique viewing in a narrow viewing angle mode, a composite image obtained by combining a primary image and a secondary image that is different from the primary image.

(a) of FIG. 11 is a diagram showing a relationship between pixel data of pixels adjacent to each other in the first region of Patent Literature 1 and the averages of luminances during square viewing and during oblique viewing, and (b) of FIG. 11 is a diagram showing a relationship between pixel data of pixels adjacent to each other in the second region of Patent Literature 1 and the averages of luminances during square viewing and during oblique viewing.

In order to cause a checkered pattern to be displayed when the liquid crystal panel is looked obliquely at, Patent Literature 1 sets up pixel data for each separate pixel as shown in (a) and (b) of FIG. 11. That is, in the first region, the pixel data of all the pixels take on a value of "189", and in the second region, the pixel data of upper left and lower right pixels of four pixels adjacent to each other take on a value of "0" and the pixel data of the remaining two pixels take on a value of "255" so that the pixel data of adjacent pixels in the second region take on different values from each other.

In this case, the averages of luminances during square viewing in the first and second regions are both 50%. Therefore, when the liquid crystal panel is looked squarely at, the first and second regions look the same way. Meanwhile, during oblique viewing, the first region has an average luminance factor of 39% and the second region has an average luminance factor of 20%. The difference in luminance between the average luminance factors is seen as a notable difference in luminance when the liquid crystal panel is looked obliquely at. As a result, a composite image obtained by combining a checkered pattern with the primary image is seen from an oblique angle. Therefore, peeking is prevented.

Further, Patent Literature 2 discloses a technique for making an image seen from an oblique angle unclear by making transmittance during square viewing and transmittance during oblique viewing different from each other by partially switching the orientation of liquid crystals in each pixel between a narrow viewing angle and a wide viewing angle.

Patent Literature 3 discloses a technique for, when a user other than a user who has logged in the device has been detected, changing the output state of an image or a sound so that it is difficult to recognize the image or the sound.

CITATION LIST

Patent Literature 1

Japanese Patent Application Publication, Tokukai, No. 2009-222943 A (Publication Date: Oct. 1, 2009)

Patent Literature 2

Japanese Patent Application Publication, Tokukai, No. 2009-64025 A (Publication Date: Mar. 26, 2009)

Patent Literature 3

Japanese Patent Application Publication, Tokukai, No. 2008-283578 A (Publication Date: Nov. 20, 2008)

SUMMARY OF INVENTION

Technical Problem

However, the technique described in Patent Literature 1 has such a problem that since the display image has been retouched, the checkered pattern is slightly visible also when the liquid crystal panel is looked squarely at.

Neither Patent Literature 2 nor 3 discloses anything about making it hard for a pattern that should be seen from an oblique angle to be seen when the liquid crystal panel is looked squarely at.

The present invention has been made in view of the foregoing problems, and it is an object of the present invention to provide a liquid crystal display device and a display method that makes it possible to protect privacy and improve the display quality of an image when the liquid crystal panel is looked squarely at, a program therefor, and a computer-readable recording medium containing such a program.

Solution to Problem

In order to solve the foregoing problems, a liquid crystal display device according to the present invention is a liquid crystal display device including: a liquid crystal panel which exhibits different gamma curves between a time when the liquid crystal panel is looked squarely at and a time when the liquid crystal panel is looked obliquely at; and a display control circuit (display control means) which divides a single frame period into a first display period and a second display period and divides a display region of the liquid crystal panel into a first region and a second region, and which causes data corresponding to different video sources to be displayed in the first region and the second region, respectively, the display control circuit having a luminance computing section which computes A to D so that A to D satisfies $A+C=B+D$ and $A\neq B\neq D$ as well as $C\neq B\neq D$, where A and C are gray-level luminances, assuming (1) that A is the maximum luminance of an output tone with respect to an input tone of pixel data that is displayed in the first region during the first display period and B is the maximum luminance of an output tone with respect to an input tone of pixel data that is displayed in the second region during the first display period, and (2) that C is the maximum luminance of an output tone with respect to an input tone of pixel data that is displayed in the first region during the second display period and D is the maximum luminance of an output tone with respect to an input tone of pixel data that is displayed in the second region during the second display period.

In order to solve the foregoing problems, a display method according to the present invention is a display method for dividing a single frame period into a first display period and a second display period and dividing, into a first region and a second region, a display region of a liquid crystal panel which exhibits different gamma curves between a time when the liquid crystal panel is looked squarely at and a time when the liquid crystal panel is looked obliquely at, and for causing data corresponding to different video sources to be displayed in the first region and the second region, respectively, the display method including the step of: computing A to D so that A to D satisfies $A+C=B+D$ and $A\neq B\neq D$ as well as $C\neq B\neq D$, where A and C are gray-level luminances, assuming (1) that A is the maximum luminance of an output tone with respect to an input tone of pixel data that is displayed in the first region during the first display period and B is the maximum luminance of an output tone with respect to an input tone of pixel data that is displayed in the second region during the first display period, and (2) that C is the maximum luminance of an output tone with respect to an input tone of pixel data that is displayed in the first region during the second display period and D is the maximum luminance of an output tone with respect to an input tone of pixel data that is displayed in the second region during the second display period.

The adjectives "first" and "second" here means that the things they describe are different from each other, and are not intended to specify the order of the things they describe.

Since A to D satisfy the foregoing conditions, the present invention makes it possible to provide a liquid crystal display device which can protect privacy and improve the display quality of an image when the liquid crystal panel is looked squarely at.

The reason for this is explained by taking as an example a case where pixel the data that is displayed in the first region is pixel data that is recognized when the liquid crystal panel is looked squarely at and the pixel data that is displayed in the second region is pixel data that is recognized when the liquid crystal panel is looked obliquely at.

In this case, the luminance of the pixel data that can be recognized when the liquid crystal panel is looked squarely at, i.e., the luminance $A+C$ of the pixel data that is displayed in the first region is equal to the luminance of the pixel data that can be recognized when the liquid crystal panel is looked obliquely at, i.e., the luminance $B+D$ of the pixel data that is displayed in the second region. For this reason, the first and second regions exhibit identical gamma curves when the liquid crystal panel is looked squarely at.

This makes it hard for the data that is displayed in the second region to be recognized when the liquid crystal panel is looked squarely at, thus making it possible to improve the display quality of an image when the liquid crystal panel is looked squarely at.

Further, since A to D satisfy the foregoing conditions, the luminance of the pixel data that is displayed during the first display period and the luminance of the pixel data that is displayed during the second display period are different from each other at least in the second region. For this reason, the second region exhibits different gamma curves during the first and second display periods when the liquid crystal panel is looked obliquely at. For this reason, the first and second regions exhibit different gamma curves when the liquid crystal panel is looked obliquely at.

Therefore, when the liquid crystal panel is looked obliquely at, an image based on the pixel data that is displayed in the second region can be recognized, but an image based on the pixel data that is displayed in the first region can hardly be recognized, so that privacy can be protected.

The liquid crystal display device or, in other words, the step of the display method may be achieved by computer. In this case, a program for causing a computer to execute the step of the display method or, in other words, a program that achieves the liquid crystal display device on a computer by causing the computer to operate as each of the means is also encompassed in the scope of the present invention. Further, a computer-readable recording medium containing such a program is also encompassed in the scope of the present invention.

Advantageous Effects of Invention

As described above, a liquid crystal display device and a display method according to the present invention each divide a single frame period into a first display period and a second display period and divide, into a first region and a second region, a display region of a liquid crystal panel which exhibits different gamma curves between a time when the liquid crystal panel is looked squarely at and a time when the liquid crystal panel is looked obliquely at, as described above, the liquid crystal display device and the display method each computing A to D so that A to D satisfies A+C=B+D and A≠B≠D as well as C≠B≠D, where A and C are gray-level luminances, assuming that A is the maximum luminance of an output tone with respect to an input tone of pixel data that is displayed in the first region during the first display period, that B is the maximum luminance of an output tone with respect to an input tone of pixel data that is displayed in the second region during the first display period, that C is the maximum luminance of an output tone with respect to an input tone of pixel data that is displayed in the first region during the second display period, and that D is the maximum luminance of an output tone with respect to an input tone of pixel data that is displayed in the second region during the second display period.

Therefore, while the first and second regions exhibits identical gamma curves when the liquid crystal panel is looked squarely at, the first and second regions exhibits different gamma curves when the liquid crystal panel is looked obliquely at.

For this reason, the present invention makes it possible to protect privacy by preventing peeking from an oblique angle and improve the display quality of an image when the liquid crystal panel is looked squarely at.

BRIEF DESCRIPTION OF DRAWINGS

FIG. 9 is a set of diagrams (a) and (b), (a) being a diagram showing a relationship between pixel data of pixels adjacent to each other in the first display region of the liquid crystal display device and the averages of luminances during square viewing and during oblique viewing, (b) being a diagram showing a relationship between pixel data of pixels adjacent to each other in the second display region of the liquid crystal display device and the averages of luminances during square viewing and during oblique viewing.

FIG. 11 is a set of diagrams (a) and (b), (a) being a diagram showing a relationship between pixel data of pixels adjacent to each other in the first region of Patent Literature 1 and the averages of luminances during square viewing and during oblique viewing, (b) being a diagram showing a relationship between pixel data of pixels adjacent to each other in the second region of Patent Literature 1 and the averages of luminances during square viewing and during oblique viewing.

DESCRIPTION OF EMBODIMENTS

An embodiment of the present invention is described in detail below.

<Schematic Configuration of a Liquid Crystal Display Device>

Figure 2:
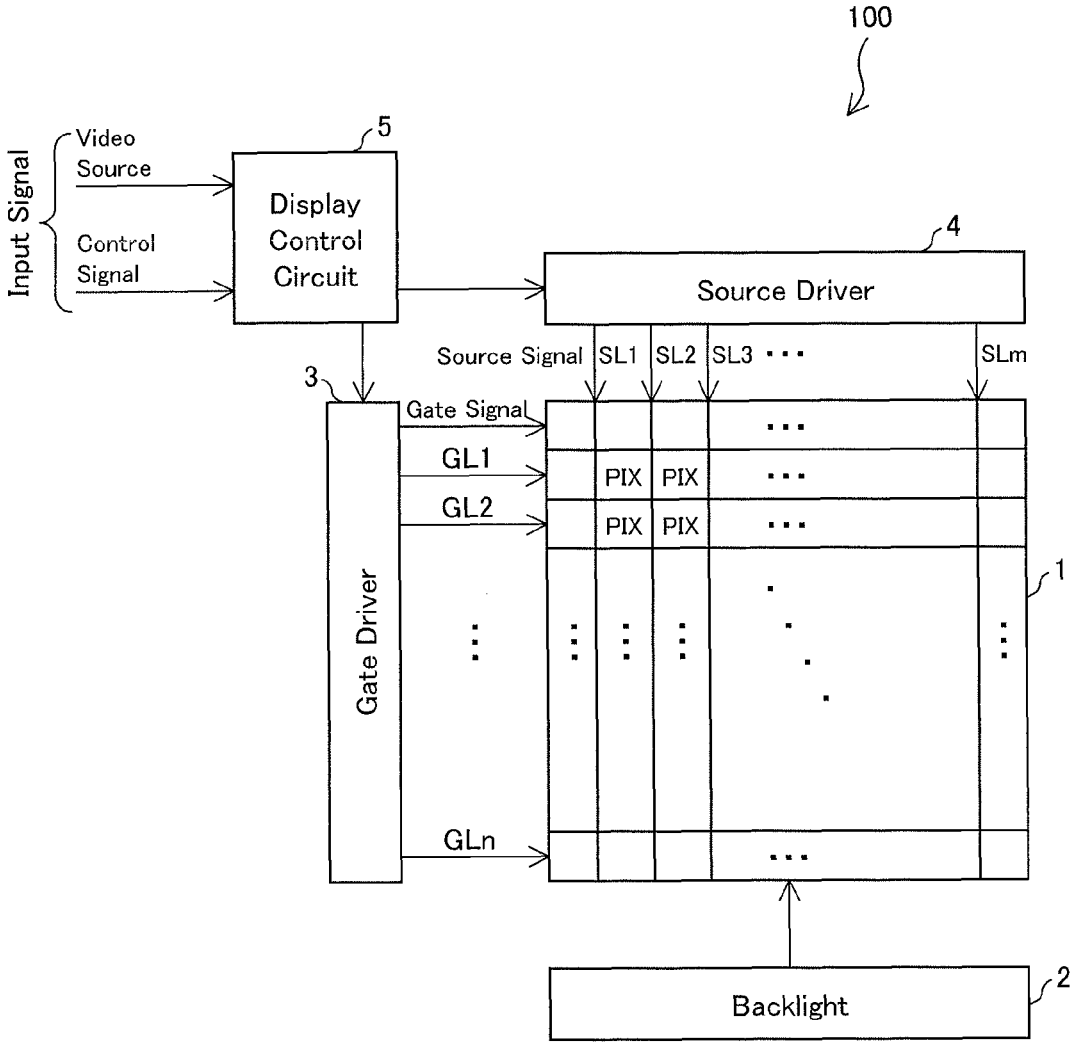
FIG. 2 is a block diagram schematically showing a configuration of a main part of a liquid crystal display device according to an embodiment of the present invention.

FIG. 2 is a block diagram schematically showing a configuration of a main part of a liquid crystal display device according to an embodiment of the present invention.

As shown in FIG. 2, a liquid crystal display device 100 according to the present embodiment includes: a liquid crystal panel 1, a backlight 2 (illuminating means), a gate driver 3, which is a driving circuit for driving the liquid crystal panel 1; a source driver 4; and a display control circuit 5 (display control means, display control section).

The backlight 2, provided behind the liquid crystal panel 1 (toward the surface of the liquid crystal panel 1 opposite to the display surface), irradiates the liquid crystal panel 1 with light.

Usable examples of the backlight 2 include an LED backlight system using LEDs (light-emitting diodes) as light-emitting elements, etc.

The liquid crystal panel 1 is an active-matrix liquid crystal panel having a plurality of pixels PIX arranged in rows and columns. The liquid crystal panel 1 has a structure in which a liquid crystal layer is sandwiched between an active-matrix substrate and a counter substrate, albeit not illustrated. Usable examples of the liquid crystal panel 1 include various publicly-known liquid crystal panels.

Therefore, no description or illustration is given here of a configuration of any of the substrates of the liquid crystal panel 1.

The liquid crystal panel 1 can be driven by any driving method that makes a difference between a gamma curve during square viewing and a gamma curve during oblique viewing. Examples of such a driving method include a VA mode, a TN mode, etc.

The liquid crystal panel 1 has a plurality of gate lines GL1, GL2, GL3, . . . , and GLn (where n is an integer of 1 or greater) and a plurality of source lines SL1, SL2, SL3, . . . , SLm (where m is an integer of 1 or greater) disposed to intersect with each other. In the following, these gate lines GL1, GL2, GL3, . . . , and GLn are collectively referred to as "gate lines GL", and these source lines SL1, SL2, SL3, . . . , SLm are collectively referred to as "source lines SL".

Each of those regions surrounded by these gate lines GL and source lines SL corresponds to a single pixel, and each of the pixels PIX is provided with a pixel electrode and a switching element such as a TFT, albeit not illustrated.

The gate lines GL are connected to the gate driver 3, and the source lines SL are connected to the source driver 4. Further, each of the switching elements has its gate electrode connected to a gate line GL, its source electrode connected to a source line SL, and its drain electrode connected to the pixel electrode.

With this, by ON/OFF (on/off) controlling the switching element, the pixel electrode is selectively supplied with a source signal. Specifically, when the switching element is supplied with a gate signal from the gate driver 3 via the gate line GL, the switching element comes into an ON state, so that the pixel electrode is supplied with a source signal flowing from the source electrode of the switching element to the drain electrode of the switching element. It should be noted that the following description assumes that the expression "gate line GL has been turned ON" refers to the time when the switching element has come into an ON state by being supplied with a gate signal from the gate driver 3 via the gate line GL.

Such a source signal is supplied from the source driver 4 via a source line SL. The source driver 4 supplies source signals (SOURCE (1), SOURCE (2): see FIG. 4) to each separate source line SL in the order of scanning in accordance with a timing signal supplied from the display control circuit 5.

The display control circuit 5 receives input data from an input data supply source (not illustrated), generates a gate control signal and a source control signal from the input data, and supplies the gate driver 3 with the gate control signal thus generated and also supplies the source driver 4 with the source control signal thus generated.

With this, the display control circuit 5 divides a single frame period into a first display period (first sub-frame) and a second display period (second sub-frame) and divides a display region of the liquid crystal panel 1 into a first region and a second region, and causes data corresponding to different video sources to be displayed in the first and second regions, respectively.

<Configuration of the Display Control Section>

The following describes a configuration of the display control circuit 5 in detail.

Figure 1:
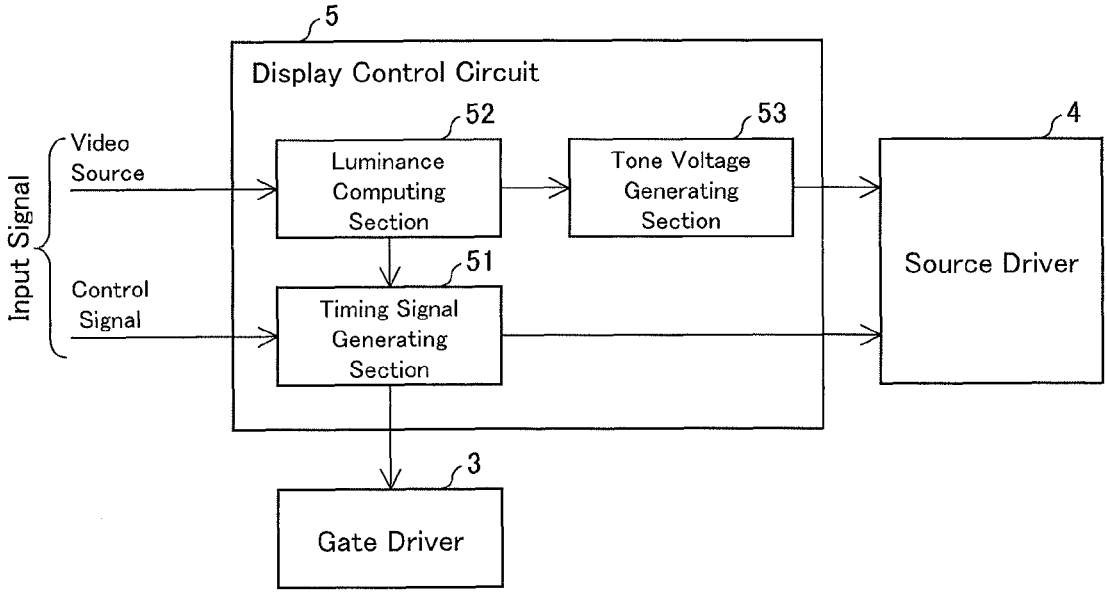
FIG. 1 is a block diagram showing a configuration of a display control circuit in a liquid crystal display device according to an embodiment of the present invention.

FIG. 1 is a block diagram showing a configuration of the display control circuit 5.

The display control circuit 5 includes a timing signal generating section 51 (timing controller, timing signal generating means), a luminance computing section 52 (luminance computing means), and a tone voltage generating section 53 (tone voltage generating means).

Input data that is inputted from the input data supply source to the display control circuit 5 contains a video source (e.g., pixel data such as RGB data) and control signals such as a horizontal synchronizing signal and a vertical synchronizing signal.

The timing signal generating section 51 receives control signals such as a horizontal synchronizing signal and a vertical synchronizing signal from the input data supply source, generates a gate control signal and a source control signal in accordance with the control signals thus received, and supplies the gate control signal and the source control signal to the gate driver 3 and the source driver 4, respectively.

The gate control signal and the source control signal are timing signals for controlling the timing of driving of the gate driver 3 and the source driver 4, respectively.

The gate control signal contains a gate start pulse, a gate shift clock pulse, a gate output enable signal, etc.

The source control signal contains a source start pulse, a source shift clock pulse, a source output enable signal, a reverse polarity signal, etc.

Examples of the input data supply source include, but are not particularly limited to, cellular phones, portable game machines, PDA (personal digital assistants), digital cameras, laptop computers, electronic books, etc. Further, the video source may be a still image or a moving image. Examples of the video source include books (texts), photographs, slide shows, word processing documents, etc.

The video source contains various pixel data such as color information and tone information on an image that is displayed on the liquid crystal panel 1.

The liquid crystal display device 100 carries out a display with the liquid crystal panel 1 having its display region divided into first and second regions that differ in shading from each other when the liquid crystal panel 1 is looked obliquely at, so that a shading pattern is displayed when the liquid crystal panel 1 is looked obliquely at.

It should be noted that the present embodiment assumes that the first region is a region that becomes a relatively light-colored region (light-colored pattern) when the liquid crystal panel 1 is looked obliquely at and the second region is a region that becomes a relatively deep-colored region (deep-colored pattern) when the liquid crystal panel 1 is looked obliquely at.

A video source that is supplied from the input data supply source contains a primary image and a secondary image that are displayed in the first and second regions, respectively, into which a display image on the liquid crystal panel 1 has been divided.

The term "primary image" here refers to an original image that is recognized during square viewing, and the term "secondary image" here refers to an image which is combined with the primary image during oblique viewing and which is different from the primary image.

Further, the liquid crystal display device 100 carries out a sub-frame display. The term "sub-frame display" here refers to a method for carrying out a display with a single frame divided into a plurality of sub-frames.

The liquid crystal display device 100 carries out a display in accordance with a single frame of video signal that is inputted during a single frame period, at a frequency twice as high as that of the video signal, and during two sub-frames (first display period, second display period) equal in size (duration).

The luminance computing section 52 (i) receives, as a video source from the input data supply source, pixel data of primary and secondary images that are displayed in the first and second regions, respectively, (ii) calculates, from the luminances of the pixel data thus received, white luminances (white-level luminances, maximum luminances) that are displayed during the first and second display periods in the first and second display regions, and (iii) sends the white luminances to the tone voltage generating section 53.

The tone voltage generating section 53 generates, from the white luminance data received from the luminance computing section 52, a signal corresponding to a tone voltage according to a display tone during each display period in each display region. Such signals serve as tone signals corresponding to the pixel data that are displayed during the first and second display periods in the first and second display regions. Then, the tone voltage generating section 53 sends the tone signals thus generated to the source driver 4 as output signals (SOURCE (1), SOURCE (2)).

The source driver 4 receives the source signals (SOURCE (1), SOURCE (2)) from the tone voltage generating section 53, and supplies the source signals to the source lines SL of the liquid crystal panel 1 in accordance with the source control signal received from the timing signal generating section 51.

<How to Compute Luminances>

The following describes how the luminance computing section 52 computes luminances (luminance computing step).

Assuming that A is the maximum luminance of an output tone with respect to an input tone of pixel data that is displayed in the first region during the first display period, that B is the maximum luminance of an output tone with respect to an input tone of pixel data that is displayed in the second region during the first display period, that C is the maximum luminance of an output tone with respect to an input tone of pixel data that is displayed in the first region during the second display period, and that D is the maximum luminance of an output tone with respect to an input tone of pixel data that is displayed in the second region during the second display period, the luminance computing section 52 computes A to D so that A to D satisfies A+C=B+D and A≠B≠D as well as C≠B≠D, where A and C are gray-level luminances. It should be noted that A and C may be identical to or different from each other.

The adjectives "first" and "second" here means that the things they describe are different from each other, and are not intended to specify the order of the things they describe. However, in order to show the order of the steps, the following description assumes, for convenience of explanation, that the first display period is a period (anterior-stage sub-frame, anterior frame) (i) which is one of two sub-frames into which a single frame period has been divided and (ii) in which a display is carried out first and the second display period is a period (posterior-stage sub-frame, posterior frame) which is the other one of the two sub-frames in which a display is carried out later than in the first display region.

Further, the following description refers to the maximum luminance of an output tone with respect to an input tone as "white luminance" for simplification of explanation.

In the following, steps of the luminance computing step are described in sequence.

The luminance computing section 52 first receives, as a video source from the input data supply source, pixel data of primary and secondary images that are displayed in the first and second regions, respectively, and determines, from the luminances of the pixel data thus received, white luminances (A+C and B+D) that are displayed during the total of the first and second display periods (i.e., during a signal frame period) in the first and second display regions. At this point in time, the white luminances that are displayed in the first and second regions, respectively, during a single frame period are set to the same value (A+C=B+D).

Next, the luminance computing section 52 determines white luminances (A and B) that are displayed in the first and second region during the first display period. After that, the luminance computing section 52 calculates, from the white luminances that are displayed during the total of the first and second display periods and the white luminances that are displayed during the first display period, white luminances (C and D) that are displayed during the second display period in the first and second regions.

For example, assuming that the tone of the white luminances that are displayed in the total of the first and second display periods is 300, that the tone of the white luminances that are displayed during the first display period is 255, and γ=2.2, the tone of the white luminances during the second display period is calculated to be 174 according to the following equation:

$$300^{2.2}-255^{2.2}=174^{2.2}.$$

Figure 3:
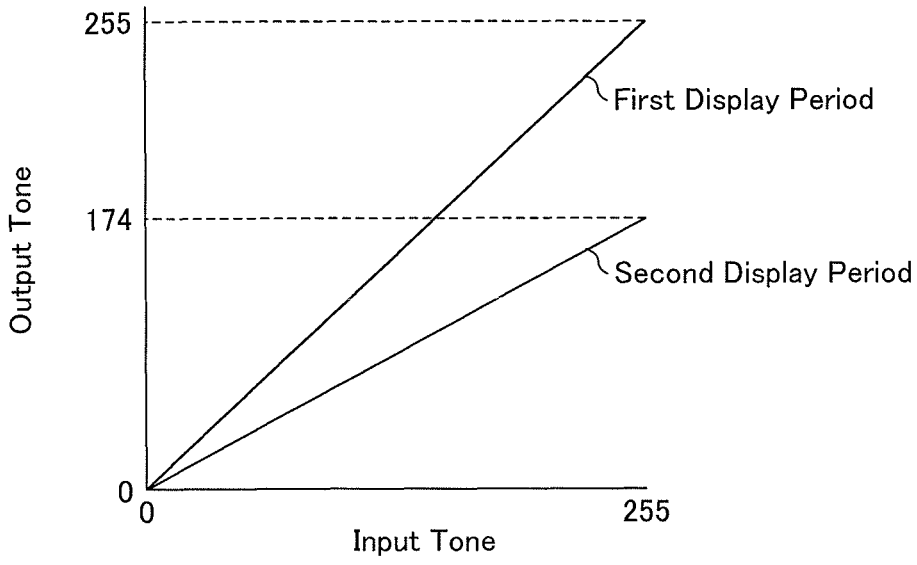
FIG. 3 is a graph showing relationships between input tones and output tones during first and second display periods, respectively, in the liquid crystal display device.

In the foregoing example, relationships between input tones and output tones during the first and second display periods, respectively, are as shown in FIG. 3.

It should be noted that the extent of luminance of light to be outputted during a single frame (i.e., the total of the first and second display periods) and the first display period is not to be particularly limited, but may be appropriately changed according to the characteristics, etc. of the device used.

<Principle of Viewing Angle Control>

Next, the principle of control of viewing angles by the liquid crystal display device 100 is described below with reference to FIG. 4 through (a) and (b) of FIG. 9.

Figure 4:
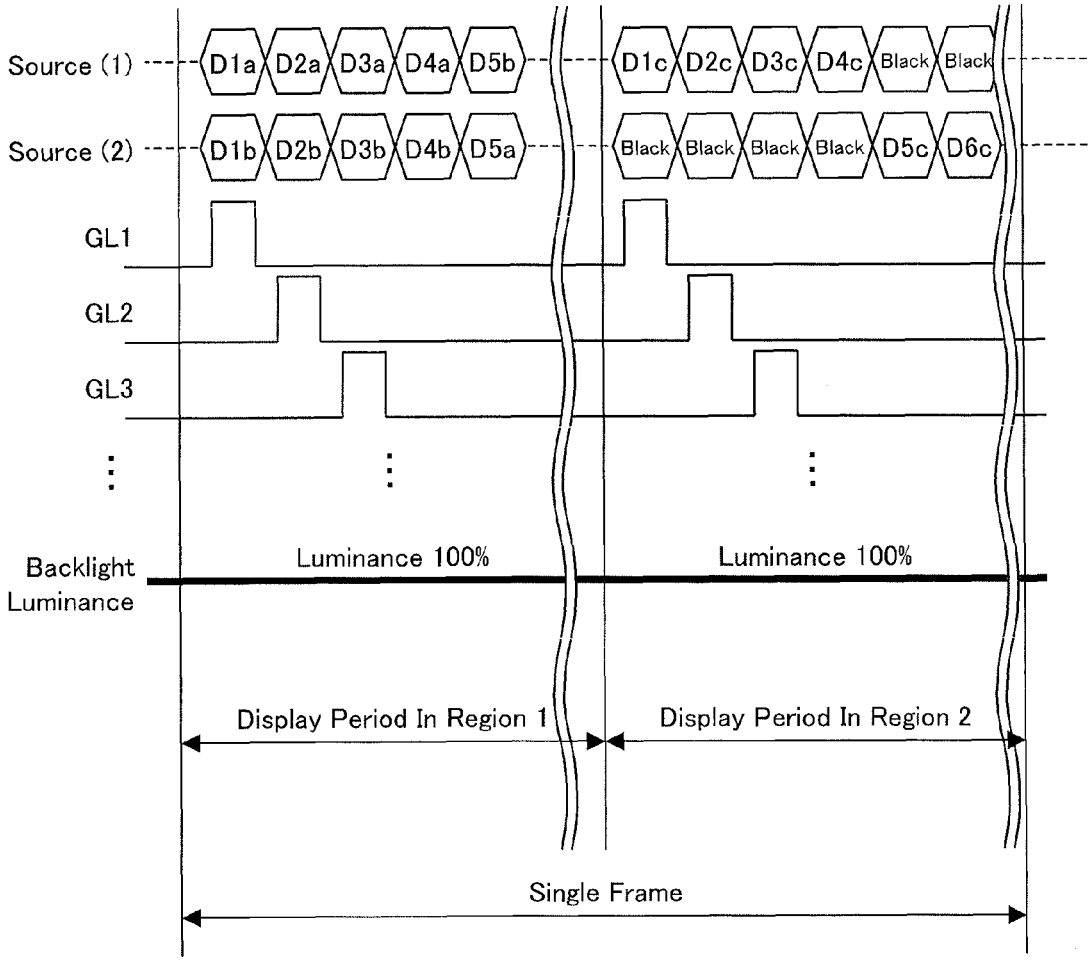
FIG. 4 is a timing chart showing operation of the liquid crystal display device.
Figure 5:
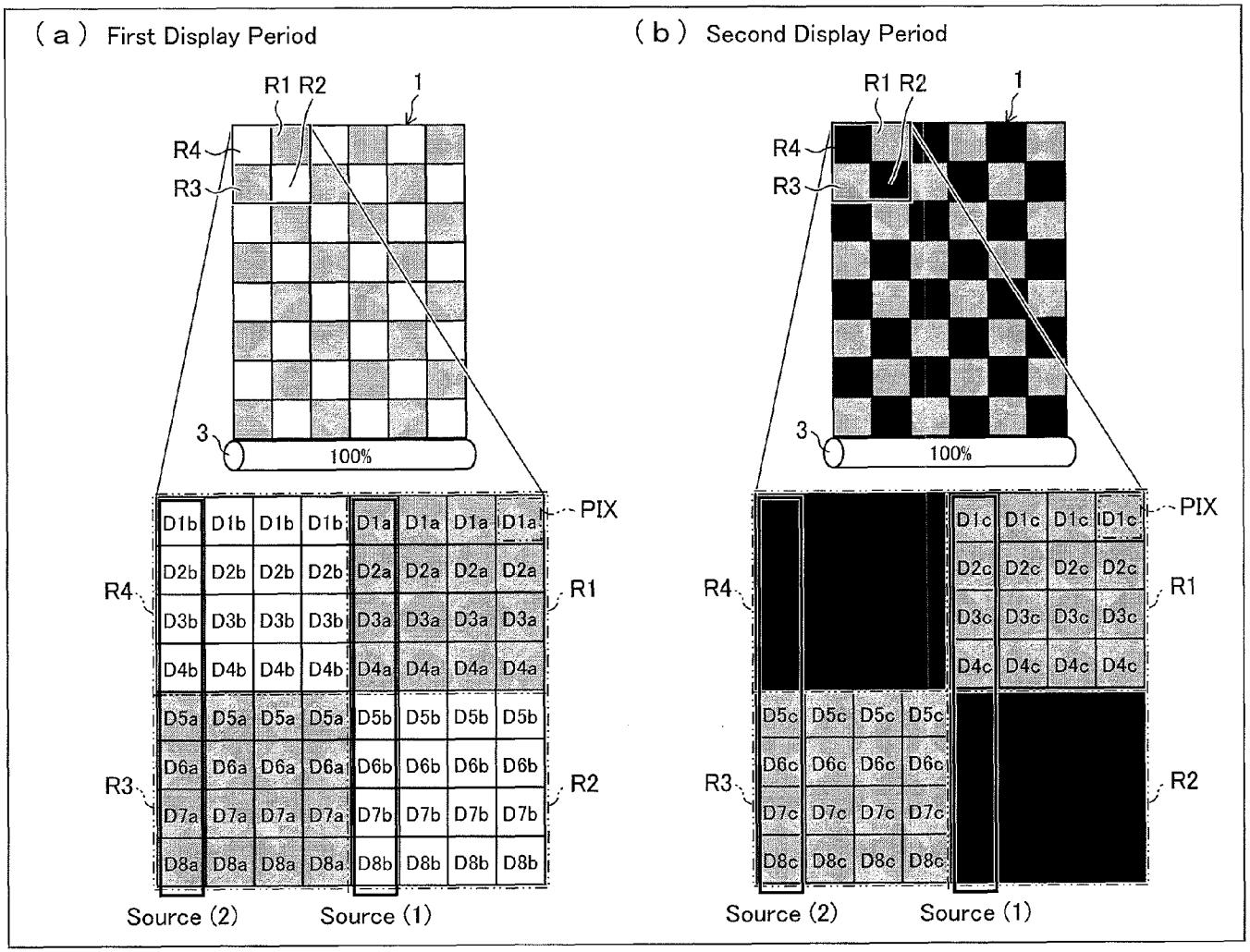
FIG. 5 is a set of diagrams (a) and (b), (a) being a diagram explaining each display region during the first display period of the liquid crystal display device and a relationship between pixel data that are written to each separate pixel in each display region and a display state of a display panel during the first display period of the liquid crystal display device, (b) being a diagram explaining each display region during the second display period of the liquid crystal display device and a relationship between pixel data that are written to each separate pixel in each display region and a display state of the display panel during the second display period of the liquid crystal display device.

FIG. 4 is a timing chart showing operation of the liquid crystal display device 100. (a) of FIG. 5 is a diagram explaining each display region during the first display period and a relationship between pixel data that are written to each display region (more specifically, individual pieces of pixel data that are written to each separate pixel PIX in each display region) and a display state of a display panel 1 during the first display period, and (b) of FIG. 5 is a diagram explaining each display region during the second display period and a relationship between pixel data that are written to each separate pixel in each display region and a display state of the display panel 1 during the second display period. (a) of FIG. 6 is a diagram showing a display state of the liquid crystal panel 1 as looked obliquely at when the first and second display periods have been averaged, (b) of FIG. 6 is a diagram showing a display state of the liquid crystal panel 1 as looked squarely at when the first and second display periods have been averaged.

For example, in a case where an non-interlace display is carried out in which a single (single-frame, single-frame-period) image display is carried out with a single scanning operation, averaging the first and second display periods means averaging the first and second display periods over a single frame period during which a single-frame display is carried out, i.e., means totalizing (combining) the first and second display periods (i.e., the first and second sub-frames).

Alternatively, for example, in a case where an interlace display is carried out in which a single image display is carried out with two scanning operations on odd-numbered lines (odd-numbered stages) and even-numbered lines (even-numbered stages), respectively, of the gate lines GL, averaging the first and second display periods means dividing a single frame, i.e., a single frame period during which a single image display is carried out, into an odd field (first sub-frame) containing odd-numbered lines and an even field (second sub-frame) containing even-numbered lines and averaging a display tone, for example, by displaying an image that is displayed in the odd field (first sub-frame) during the first display period and displaying an image that is displayed in the even field (second sub-frame) during the second display period.

Figure 6:
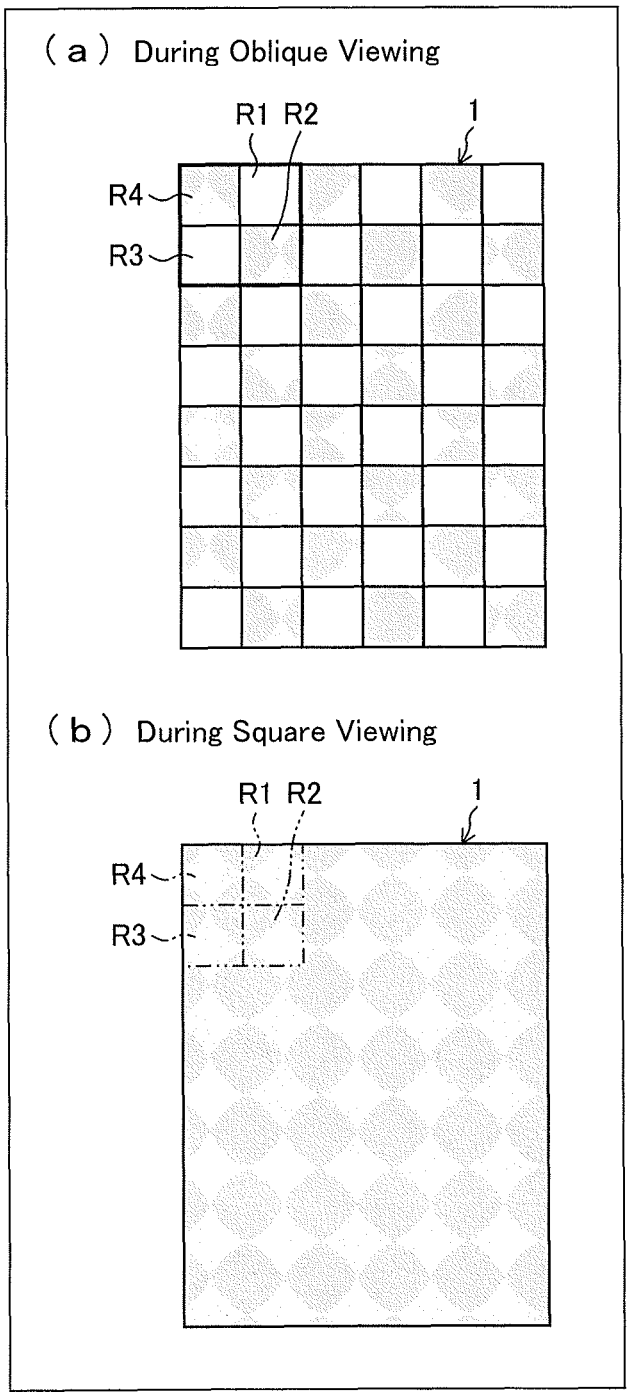
FIG. 6 is a set of diagrams (a) and (b), (a) being a diagram showing a display state of the liquid crystal panel as looked obliquely at when the first and second display periods have been averaged in the liquid crystal display device, (b) being a diagram showing a display state of the liquid crystal panel as looked squarely at when the first and second display periods have been averaged in the liquid crystal display device.

Further, the following description takes as an example a case where as shown in (a) of FIG. 6, a shading pattern in the form of a checkered pattern is displayed when the liquid crystal panel 1 is looked obliquely at.

Further, the following description assumes that when the first and second display periods have been averaged as shown in (a) of FIG. 6, the first region is a light-colored portion of the checkered pattern when the liquid crystal panel 1 is looked obliquely at and the second region is a deep-colored portion of the checkered pattern when the liquid crystal panel 1 is looked obliquely at.

In (a) of FIG. 5, part of the display region of the liquid crystal panel 1 during the first display period is surrounded with a frame, and the framed part is shown in enlarged form. In (b) of FIG. 5, part of the display region of the liquid crystal panel 1 during the second display period is surrounded with a frame, and the frame part is shown in enlarged form. Of the display regions surrounded with the frames in (a) and (b) of FIG. 5, the regions R1 and R3 constitute the first region, and the regions R2 and R4 constitute the second region.

As shown in FIG. 4, the gate lines GL are scanned in sequence from GL1 to GLn during the first display period. Similarly, as shown in FIG. 4, the gate lines GL are scanned in sequence from GL1 to GLn during the second display period.

As shown in FIG. 4, the liquid crystal display device 100 turns ON (on) all the gate lines GL1 to GLn of the liquid crystal panel 1 once each during the first and second display periods (i.e., the first sub-frame period and the second sub-frame period), thereby displaying different images (image data) once each during a single frame period in accordance with SOURCE (1) and SOURCE (2).

It should be noted that it is assumed that the luminance of light that is outputted from the backlight 2 is constant (100%) during each display period and in each region.

As shown in FIG. 4 and (a) of FIG. 5, during the first display period, pixel data "D1*a*", "D2*a*", "D3*a*", "D4*a*", "D5*b*", "D6*b*", "D7*b*", and D8*b*" are outputted in sequence as SOURCE (1) to the liquid crystal panel 1, and pixel data "D1*b*", "D2*b*", "D3*b*", "D4*b*", "D5*a*", "D6*a*", "D7*a*", and D8*a*" are outputted in sequence as SOURCE (2) to the liquid crystal panel 1.

Meanwhile, as shown in FIG. 4 and (b) of FIG. 5, during the second display period, pixel data "D1*c*", "D2*c*", "D3*c*", and "D4*c*" are outputted in sequence as SOURCE (1) to the liquid crystal panel 1, and then black data is outputted four times in succession as SOURCE (1) to the liquid crystal panel 1. Further, after the black data has been outputted four times in succession as SOURCE (2) to the liquid crystal panel 1, pixel data "D5*c*", "D6*c*", "D7*c*", and "D8*c*" are outputted in sequence as SOURCE (2) to the liquid crystal panel 1.

As a result, when the gate line GL1 is turned ON during the first display period as shown in FIG. 4, the pixel data "D1*a*" is written to those pixels PIX in the region R1 which are driven via the gate line GL1, and the pixel data "D1*b*" is written to those pixels PIX in the region R4 which are driven via the gate line GL1, as shown in (a) of FIG. 5.

After that, when the gate line GL2, the gate line GL3, and the gate line GL4 (not illustrated) are turned ON in sequence during the first display period, the pixel data "D2*a*", "D3*a*", and "D4*a*" are written to those pixels PIX in the region R1 which are driven via these gate lines GL, respectively, and the pixel data "D2*b*", "D3*b*", and "D4*b*" are written to those pixels PIX in the region R4 which are driven via these gate lines, respectively, as shown in (a) of FIG. 5.

When the gate line GL5 (not illustrated) is turned ON after the four pieces of pixel data have been written to each of the regions R1 and R4, the pixel data "D5*b*" is written to those pixels PIX in the region R2 which are driven via the gate line GL5, and the pixel data "D5*a*" is written to those pixels PIX in the region R3 which are driven via the gate line GL5. In the same manner as above, the pixel data based on SOURCE (1) and SOURCE (2) are written to each separate pixel PIX in the region R3 and in the region R2.

When the gate line GL1 is turned ON during the second display period, the pixel data "D1*c*" is written to those pixels PIX in the region R1 which are driven via the gate line GL1, and the black data is written to those pixels in the region R4 which are driven via the gate line GL1, as shown in (b) of FIG. 5.

After that, when the gate line GL2, the gate line GL3, and the gate line GL4 (not illustrated) are turned ON in sequence during the second display period, the pixel data "D2*c*", "D3*c*", and "D4*c*" are written to those pixels PIX in the region R1 which are driven via these gate lines GL, respectively, and the black data is successively written to those pixels PIX in the region R4 which are driven via these gate lines GL, respectively, as shown in (b) of FIG. 5.

When the gate line GL5 (not illustrated) is turned ON after the four pieces of pixel data have been written to each of the regions R1 and R4, the black data is written, during the second display period as shown in (b) of FIG. 5, to those pixels PIX in the region R2 which are driven via the gate line GL5, and the pixel data "D5*c*" is written, during the second display period as shown in (b) of FIG. 5, to those pixels PIX in the region R3 which are driven via the gate line GL5. In the same manner as above, the pixel data based on SOURCE (1) and SOURCE (2) are written to each separate pixel PIX in the region R3 and in the region R2.

Table 1 shows examples of tones of white luminance that are displayed during the first and second display periods in the first and second regions, respectively.

TABLE 1

| | Tones of white luminance to be displayed during total of first and second display periods | Tones of white luminance during first display period | Tones of white luminance during second display period |
|---|---|---|---|
| First region | 255 | 186 | 186 |
| Second region | 255 | 255 | 0 |

Figure 7:
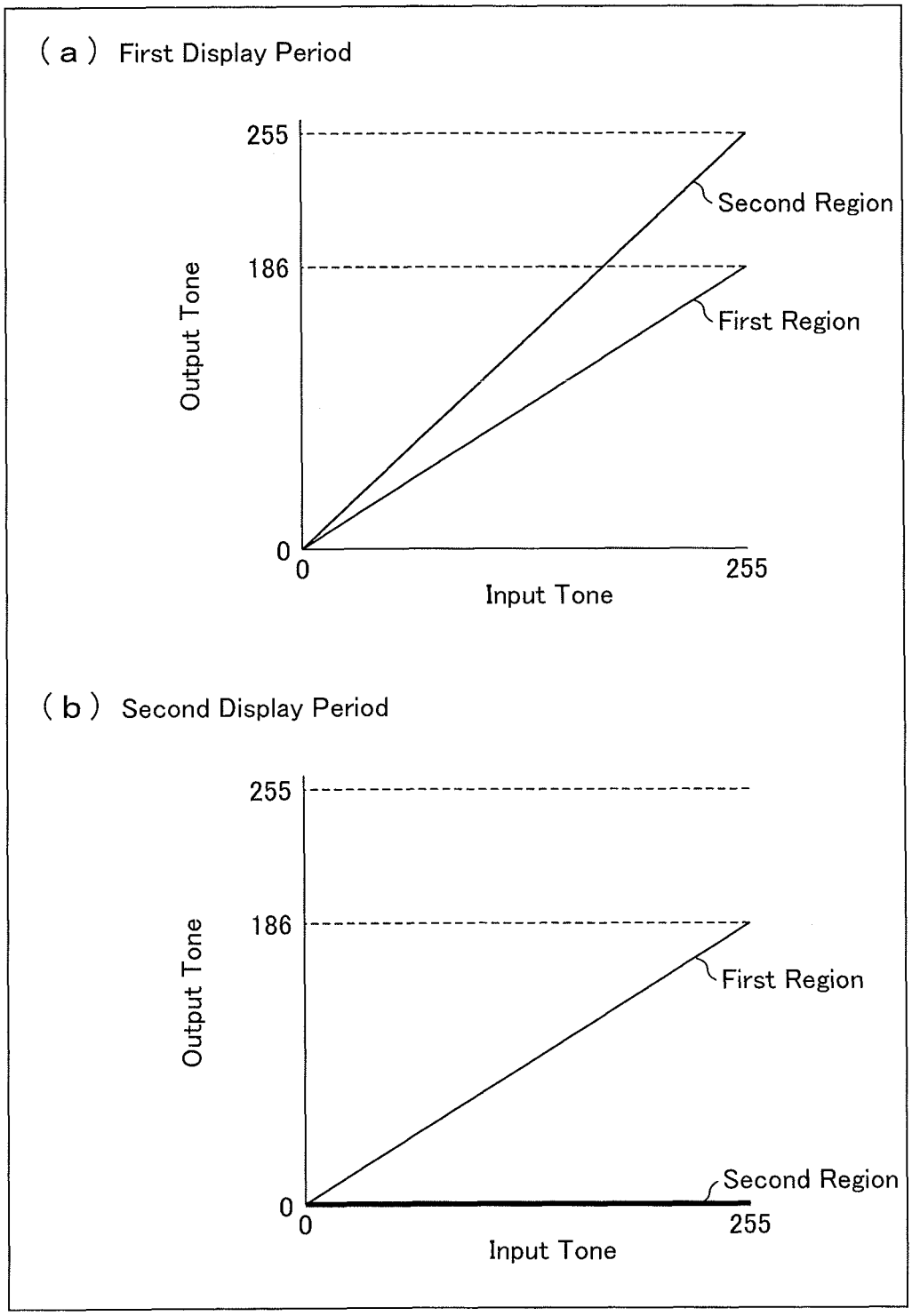
FIG. 7 is a set of graphs (a) and (b), (a) being a graph showing a relationship between input tones and output tones during the first display period of the liquid crystal display device, (b) being a graph showing a relationship between input tones and output tones during the second display period of the liquid crystal display device.

(a) and (b) of FIG. 7 show relationship between input tones and output tones during the first and second display periods as shown in Table 1, respectively.

As shown in (a) of FIG. 7, the output tone of pixel data that is written to the first region during the first display period is 186, and the output tone of pixel data that is written to the second region during the first display period is 255.

That is, while the output tone is approximately half the input tone in the first region during the first display period, the input tone is equal to the output tone in the second region during the first display period. In this manner, the output tone of pixel data that is written to the first region is low during the first display period. For this reason, assuming the luminance of the backlight 2 as 100%, the first region appears to be dark and grayish during the first display period. This causes the pattern that is displayed on the liquid crystal panel 1 during the first display period to be a white-and-gray checkered pattern as shown in (a) of FIG. 5.

Meanwhile, as shown in (b) of FIG. 7, the output tone of pixel data that is written to the first region during the second display period is 186, and the output tone of pixel data that is written to the second region during the second display period is 0. This causes the pattern that is displayed on the liquid crystal panel 1 during the second display period to be a gray-and-black checkered pattern as shown in (b) of FIG. 5.

Averaging these first and second display periods causes a checkered pattern as shown in (a) of FIG. 6 to appear when the liquid crystal panel 1 is looked obliquely at (during oblique viewing), but causes a single solid screen image as shown in (b) of FIG. 6 to appear when the liquid crystal panel 1 is looked squarely at (during square viewing).

As a result, image data based on SOURCE (1) and SOURCE (2) is viewed as a primary image during square viewing, and a composite image obtained by combining a checkered pattern as shown in (b) of FIG. 6 as a secondary image with the primary image is viewed during oblique viewing.

The reason for this is explained in detail with reference to gamma curves.

Figure 8:
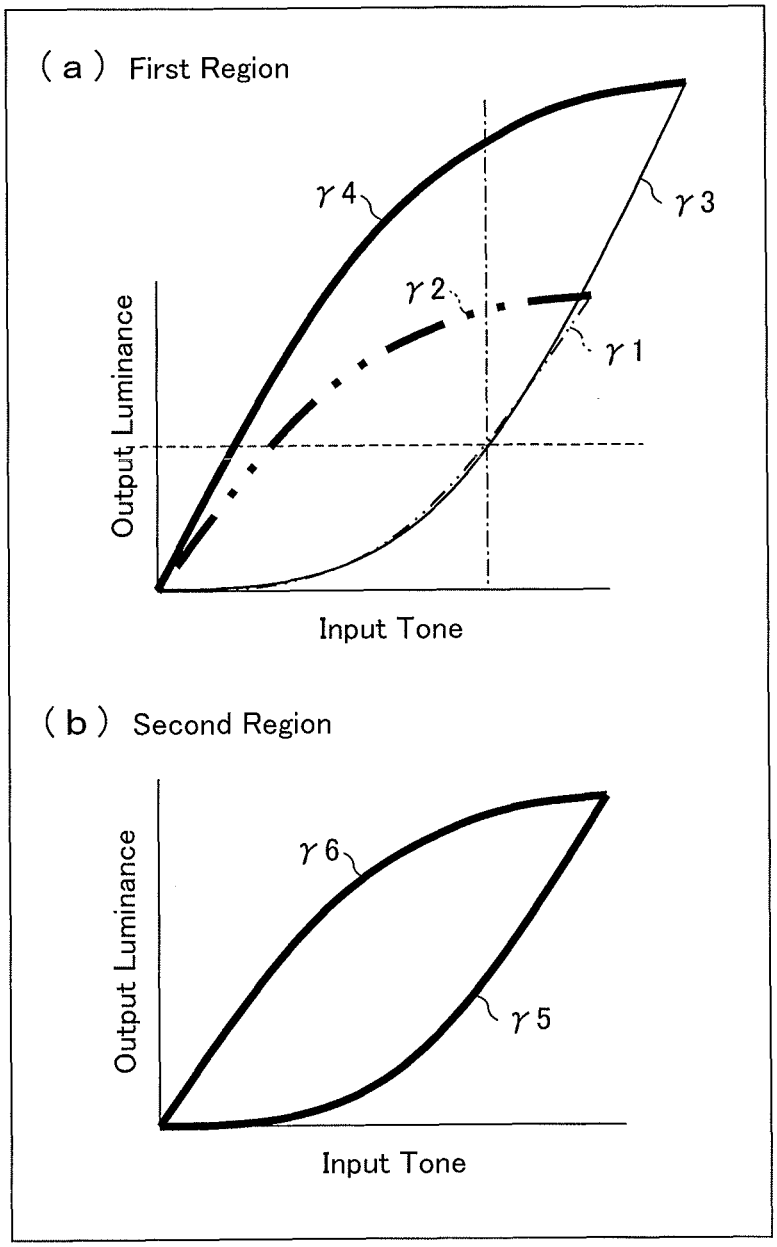
FIG. 8 is a set of diagrams (a) and (b), (a) being a diagram showing a gamma characteristic in a first region of a liquid crystal panel 1 of the liquid crystal display device, (b) being a diagram showing a gamma characteristic in a second region of the liquid crystal panel 1 of the liquid crystal display device.
Figure 10:
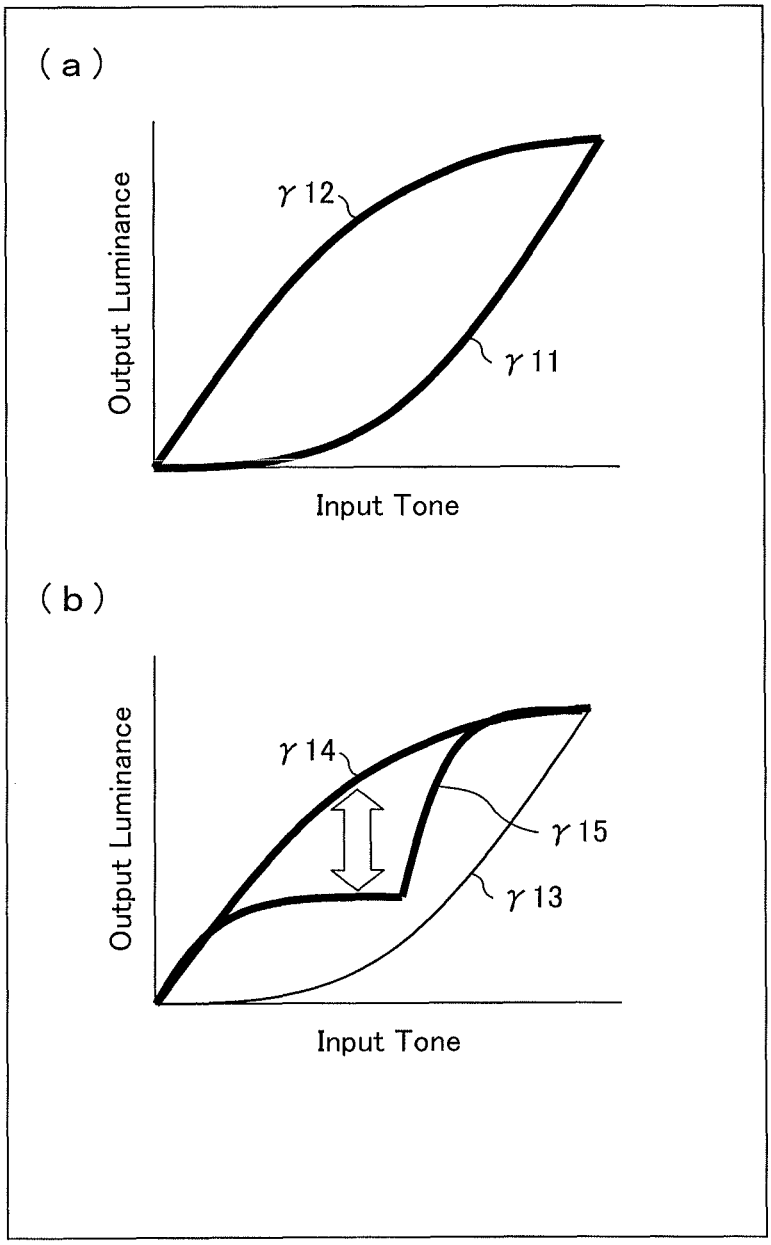
FIG. 10 is a set of diagrams (a) and (b), (a) being a diagram showing a gamma characteristic of a typical VA liquid crystal panel, (b) being a diagram showing a gamma characteristic obtained by using a multi-gamma technique.

(a) of FIG. 8 is a diagram showing a gamma characteristic (gamma curve) in the first region of the liquid crystal panel 1, and (b) of FIG. 8 is a diagram showing a gamma characteristic (gamma curve) in the second region of the liquid crystal panel 1.

In (a) of FIG. 8, the chain double-dashed line indicates a gamma curve during a single display period (i.e., during the first or second display period), and the solid line indicates a gamma curve obtained by averaging (combining) the first and second display periods. (b) of FIG. 8 shows a gamma curve obtained by averaging the first and second display periods.

Further, in (a) and (b) FIG. 8, γ1, γ3, and γ5 indicate gamma curves during square viewing, and γ2, γ4, and γ6 indicate gamma curves during oblique viewing.

As shown in Table 1, (a) and (b) of FIG. 5, and (a) and (b) of FIG. 7, a display (white display) at a maximum luminance (output tone=255) is carried out during the first display period in the second region, and a display (black display) at a minimum luminance (output tone=0) is carried out during the second display period in the second region. For this reason, as indicated by γ5 and γ6 in (b) of FIG. 8, a gamma curve obtained by averaging the first and second display periods in the second display region becomes identical to a gamma curve that is exhibited by a typical liquid crystal panel.

Meanwhile, in the first region, as shown in Table 1, (a) and (b) of FIG. 5, and (a) and (b) of FIG. 7, the gray tone is the brightest tone throughout the first and second display periods. That is, in (b) of FIG. 8, the highest tone is at the place (intersection) where γ1 intersects with the output tone indicated by the dotted line (tone of white luminance=186). Further, as indicated by the intersection between the dashed line and γ2, the value of γ2 at this point is an output luminance as seen from an oblique angle.

In the first region, two displays are carried out at the same gray-level luminance (i.e., at a tone of 186) during the first and second display periods; therefore, the output luminance during oblique viewing as obtained by averaging the first and second display periods is twice higher than the output luminance during each of the display periods. Therefore, as indicated by γ4 and γ6, the first and second regions become different in brightness from each other when the liquid crystal panel 1 is looked obliquely at. That is, when the liquid crystal panel 1 is looked obliquely at, the difference in luminance between the first and second regions appears as a pattern.

Thus, in the liquid crystal display device 100, the first and second regions exhibit different gamma curves during oblique viewing. Therefore, the liquid crystal display device 100 shows a checkered pattern when looked obliquely at.

Meanwhile, the first and second regions exhibits identical gamma curves during square viewing. For this reason, when identical tones are displayed, the first and second regions look the same way as each other as shown in (b) of FIG. 6.

The principle of control of viewing angles in the present invention is described below with reference to (a) and (b) of FIG. 9 and (a) and (b) of FIG. 11, in contrast with the technique described in Patent Literature 1.

(a) and (b) of FIG. 9 are diagrams showing relationships between pixel data of pixels adjacent to each other in the first and second display regions, respectively, of the liquid crystal display pane 100 and the averages of luminances during square viewing and during oblique viewing, with the luminance of the backlight 2 being assumed as constant (100%).

For the purpose of contrast, the following description takes as an example a case where the first and second regions are each constituted by a pixel group consisting of four adjacent pixels.

As with the present invention, Patent Literature 1 displays, in one of the first and second regions (first region), a primary image that is recognized when the liquid crystal panel is looked squarely at, and displays, in the other region (second region), a secondary image that is different from the primary image.

However, in order to cause a checkered pattern to be displayed when the liquid crystal panel is looked obliquely at, Patent Literature 1 displays pixel data of the same luminance in all of the four adjacent pixels in the first region as shown in (a) of FIG. 11, and coverts pixel data of the secondary image in the second region, as shown in (b) of FIG. 11, so that the pixel data of the secondary image are equal in luminance to the pixel data of the primary image in the first region.

For this reason, in Patent Literature 1, of the four pixels in the second region, the upper left and lower right pixels have a luminance factor of 0% during square viewing, and the upper right and lower left pixels have a luminance factor of 100% during square viewing, as shown in (b) of FIG. 11. Meanwhile, in the first region, each pixel has a luminance factor of 50% during square viewing. This causes the first and second regions to look differently from each other. As a result, a combination of the primary image and the secondary image causes a pixel pattern of the secondary image due to the difference in luminance factor to be seen even during square viewing.

On the other hand, the present invention divides a single frame into first and second display periods (sub-frames), and as shown in (a) of FIG. 9, displays pixel data of the same luminance in all of the four adjacent pixels during both the first and second display periods in the first region.

Meanwhile, as shown in (b) of FIG. 9, the present invention displays pixel data of the same luminance in all of the four adjacent pixels during the first display period in the second region, and, during the second period, displays pixel data of a different luminance from that during the first display period.

At this point in time, the luminance of pixel data of the secondary image is calculated so that the total of the luminance of the pixel data displayed during the first display period in the second region and the luminance of the pixel data displayed during the second display period in the second region is equal to the total of the luminance of the pixel data of the primary image displayed during the first display period in the first region and the luminance of the pixel data of the primary image displayed during the second display period in the first region.

This causes the first and second region to be identical in pixel data during the total of the first and second display periods as shown in (a) and (b) of FIG. 9, so that the first and second region are also equal in luminance factor during square viewing.

Therefore, the luminance of the secondary image as viewed from a square angle is exactly the same as the luminance of the primary image, so that the pattern of the secondary image that should be seen from an oblique angle is no longer recognized when the first and second region are looked squarely at. That is, as shown in (b) of FIG. 6, the first and second regions look the same way when looked squarely at.

That is, the present invention does not attain the intended luminance factor by setting adjacent pixels to different luminance factors and averaging the luminance factors as has conventionally been done. In other words, the present invention does not express the intended tone by setting the luminance factors in adjacent pixels to different values and generating a gray level therebetween as has conventionally been done. As shown in (a) and (b) of FIG. 9, the pixel data that are displayed in adjacent pixels during a single frame period are equal in luminance factor.

For this reason, the present invention can prevent a pattern that is supposed to be seen from an oblique angle from being seen from a square angle, thus making it possible to improve the display quality of an image when the liquid crystal panel 1 is looked squarely at.

Meanwhile, the first and second regions differ in luminance factor from each other during oblique viewing. This causes the pixel pattern of the secondary image due to the difference in luminance factor to be seen during square viewing. That is, shading due to the difference in luminance factor appears as a pattern.

Therefore, the present invention makes it possible to protect privacy by preventing peeking from an oblique angle and improve the display quality of an image when the liquid crystal panel is looked squarely at.

The present embodiment has been described by taking as an example a case where black data and image data are written as SOURCE (1) and SOURCE (2) (that is, black data is inserted). However, the present embodiment needs only satisfy the expression (1), and does not always need to include black data in SOURCE (1) and SOURCE (2) (that is, does not always need to carry out a black display).

However, as mentioned above, the present embodiment carries out viewing angle control by using a difference in luminance between the first and second regions. For this reason, the greater the difference in luminance between the first and second regions is, the more conspicuous the pattern (secondary image) can be made when the liquid crystal panel 1 is looked obliquely at.

Therefore, it is preferable to include black data in either SOURCE (1) or SOURCE (2) (i.e., to carry out a black display in the second region during the first or second display period).

That is, it is preferable that either one of B and D computed by the luminance computing section 52 be a black level of luminance and the other one of B and D be a white level of luminance.

Further, since A is equal to C, either one of B and D is a black level of luminance, and the other one of B and D is a white level of luminance, the difference in luminance between pixel data that are displayed in the first and second regions during a single frame period is the greatest when the liquid crystal panel 1 is looked obliquely at. This makes it possible to enlarge the difference in shading between images in the first and second regions when the liquid crystal panel 1 is looked obliquely at. This makes it harder to recognize the image that is displayed in the first region, thus making it possible to further enhance the effect of privacy protection.

<Modification>

It should be noted that the present invention is not to be particularly limited in terms of how many first and second regions are placed in which region in the display region of the liquid crystal panel 1.

That is, the first and second regions need only be arranged to create a shading pattern when the liquid crystal panel 1 is looked obliquely at, and as mentioned above, the first and second regions may be disposed in a checkered pattern obtained by placing a second region 2 in each region adjacent to a plurality of first regions.

In other words, the secondary image that is displayed during oblique viewing is not to be particularly limited, and may for example be a checkered pattern as mentioned above. It should be noted that the secondary image can take any shape such as a logo, a star, or a heart.

Further, the present invention is also applicable to driving of a field-sequential color liquid crystal display device. That is, the liquid crystal display device 100 may carry out a color display according to the field-sequential system and carry out area-active driving control of the backlight 2. In carrying out a color display according the field-sequential system, the liquid crystal panel 1 being suitably used is a liquid crystal panel including ferroelectric liquid crystals that are suitable to the field-sequential system and that are fast in response speed.

Further, the present embodiment has been described by taking an example a case where the backlight luminances in the first and second display regions are 100% each. However, the present invention is not to be limited to such an example. A combination of backlight luminance and tone voltage may be appropriately adjusted so that the data on the white luminances A and B for the first and second regions, respectively, are sent to the source driver 4 during the first display period and the data on the white luminances C and D for the first and second regions, respectively, are sent to the source driver during the second display period.

In any case, the present invention brings about the aforementioned effects by the luminance computing section computing, in the luminance computing step, the maximum luminances (white luminances) of output tones with respect to input tones of pixel data that are displayed in the first and second regions during the first and second display periods, respectively, so that the first and second regions exhibit identical gamma curves when the liquid crystal panel 1 is looked squarely at and that the first and second regions exhibit different gamma curves when the liquid crystal panel 1 is looked obliquely at.

The present embodiment has been described by taking as an example a case where the backlight 2 is used as a light source; however, the present embodiment is not to be limited to such an example. For example, the backlight 2 may be replaced by a front light (not illustrated).

As described above, the present invention can be used for various purposes that require a narrow viewing angle display in which an image that is seen when the liquid crystal panel 1 is looked obliquely at is different from an image that is seen when the liquid crystal panel 1 is looked squarely at. It should be noted that the liquid crystal display device may be used switchably between a narrow viewing angle and a wide viewing angle, or may be used for purposes that mostly require a narrow viewing angle.

<Program and a Computer-Readable Recording Medium>

Further, the blocks of the liquid crystal display device 100 or, in particular, the luminance computing section 52, etc. of the display control circuit 5 may be achieved through hardware logic or through software by using a CPU (central processing unit) or an MPU (micro processing unit) as described below. In other words, the steps of a display method according to the present invention may be executed through software by using a program.

That is, the liquid crystal display device 100 include: a CPU or an MPU, which executes instructions from a program for achieving the corresponding function (step); a ROM (read only memory), in which the program is stored; an RAM (random access memory), to which the program is loaded in an executable format; a memory device (recording medium), such as a memory, in which the program and various types of data are stored; and the like.

Moreover, the object of the present invention can be attained by mounting, to the display control circuit 5, a recording medium computer-readably containing a program code (execute form program, intermediate code program, or source program) of a program for controlling the display control circuit 5, which is software for achieving the aforementioned functions (steps), in order for the computer (CPU or MPU) to retrieve and execute the program code recorded in the recording medium.

It should be noted that the recording medium from which the program code is supplied to the liquid crystal display device 100 is not limited to a particular structure or type. Examples of the recording medium include: tapes, such as magnetic tapes and cassette tapes; disks including magnetic disks, such as floppy disks (registered trademark) and hard disks, and optical disks, such as CD-ROMs, MOs, MDs, DVDs, and CD-Rs; cards, such as IC cards (including memory cards) and optical cards; and semiconductor memories, such as mask ROMs, EPROMs, EEPROMs, and flash ROMs.

Further, the object of the present invention can also be attained by making the liquid crystal display device 100 connectable to a communication network. In this case, the program code is supplied to the liquid crystal display device 100 via the communication network. The communication network needs only be one via which the program code can be supplied to the liquid crystal display device 100, and is not limited to a particular type or configuration. Examples of the communication network include the Internet, an intranet, an extranet, a LAN, ISDN, a VAN, a CATV communication network, a virtual private network, a telephone line network, a mobile communication network, a satellite communication network, etc.

Further, a transmission medium constituting the communication network needs only be any medium that can transmit the program code, and is not limited to a particular configuration or type. For example, it is possible to use, as the transmission medium, a cable system such as IEEE 1394, a USB, a power line, a cable TV line, a telephone line, an ADSL line, etc. Alternatively, it is possible to use, as the transmission medium, a wireless system such as infrared rays as in IrDA and a remote controller, Bluetooth (registered trademark), 802.11 wireless, HDR, a cellular-phone network, a satellite line, a terrestrial digital network, etc. It should be noted that the present invention can be achieved in the form of a computer data signal realized by electronic transmission of the program code and embedded in a carrier wave.

<Outline of Essential Points>

As described above, a liquid crystal display device according to the present embodiment is a liquid crystal display device including: a liquid crystal panel which exhibits different gamma curves between a time when the liquid crystal panel is looked squarely at and a time when the liquid crystal panel is looked obliquely at; and a display control circuit (display control means) which divides a single frame period into a first display period and a second display period and divides a display region of the liquid crystal panel into a first region and a second region, and which causes data corresponding to different video sources to be displayed in the first region and the second region, respectively, the display control circuit having a luminance computing section (luminance computing means) which computes A to D so that A to D satisfies $A+C=B+D$ and $A \neq B \neq D$ as well as $C \neq B \neq D$, where A and C are gray-level luminances, assuming (1) that A is the maximum luminance of an output tone with respect to an input tone of pixel data that is displayed in the first region during the first display period and B is the maximum luminance of an output tone with respect to an input tone of pixel data that is displayed in the second region during the first display period, and (2) that C is the maximum luminance of an output tone with respect to an input tone of pixel data that is displayed in the first region during the second display period and D is the maximum luminance of an output tone with respect to an input tone of pixel data that is displayed in the second region during the second display period.

Further, a display method according to the present embodiment is a display method for dividing a single frame period into a first display period and a second display period and dividing, into a first region and a second region, a display region of a liquid crystal panel which exhibits different gamma curves between a time when the liquid crystal panel is looked squarely at and a time when the liquid crystal panel is looked obliquely at, and for causing data corresponding to different video sources to be displayed in the first region and the second region, respectively, the display method including the step of: computing A to D so that A to D satisfies $A+C=B+D$ and $A \neq B \neq D$ as well as $C \neq B \neq D$, where A and C are gray-level luminances, assuming (1) that A is the maximum luminance of an output tone with respect to an input tone of pixel data that is displayed in the first region during the first display period and B is the maximum luminance of an output tone with respect to an input tone of pixel data that is displayed in the second region during the first display period, and (2) that C is the maximum luminance of an output tone with respect to an input tone of pixel data that is displayed in the first region during the second display period and D is the maximum luminance of an output tone with respect to an input tone of pixel data that is displayed in the second region during the second display period.

Therefore, while the first and second regions exhibits identical gamma curves when the liquid crystal panel is looked squarely at, the first and second regions exhibits different gamma curves when the liquid crystal panel is looked obliquely at.

For this reason, each of the foregoing configurations makes it possible to protect privacy by preventing peeking from an oblique angle and improve the display quality of an image when the liquid crystal panel is looked squarely at.

A to D as computed by the luminance computing section are preferably such that: $A=C$; and either one of B and D is a black level of luminance, and the other one of B and D is a white level of luminance.

In other words, it is preferable that: in the step, A to D are computed so that $A=C$, that either one of B and D is a black level of luminance, and that the other one of B and D is a white level of luminance.

According to each of the foregoing configurations, the difference in luminance between pixel data that are displayed in the first and second regions, respectively, during a single frame period is the greatest when the liquid crystal panel is looked obliquely from. This makes it possible to enlarge the difference in shading between images in the first and second regions when the liquid crystal panel is looked obliquely at. Therefore, each of the foregoing configurations makes it harder to recognize the image that is displayed in the first region.

The first and second regions both show images that are recognized when the liquid crystal panel is looked squarely at.

By thus causing the first and second regions to exhibit identical gamma curves when the liquid crystal panel is looked squarely at, the present invention shows a normal display when the liquid crystal panel is looked squarely at.

However, since the first and second regions exhibit different gamma curves when the liquid crystal panel is looked obliquely at, a pattern (e.g., a checkered pattern) that is constituted by the data that are displayed in the first and second regions in a case where the liquid crystal panel is looked obliquely at appears as an image that is recognized when the liquid crystal display is looked obliquely at.

Therefore, the data that is displayed in the first region and the data that is displayed in the second region are data that constitute an image (i.e., the pattern) which is recognized when the liquid crystal display is looked obliquely at.

In order to protect privacy when the liquid crystal panel is looked obliquely at, the present invention does not utilize on the data that is displayed in either one of the first and second regions, but utilizes the difference in luminance between the first and second region to constitute an image that is recognized when the liquid crystal panel is looked obliquely at, so that the privacy can be protected.

Further, A to D can be computed as follows:

The step includes a first step of determining, from the luminances of image data in the video sources which are displayed in the first and second display regions, A+C and B+D to be displayed in a total of the first and second display periods in the first and second regions, so that A+C=B+D; a second step of determining A and B to be displayed in the first and second regions during the first display period; and a third step of calculating, from A+C and B+D as determined in the first step and A and B as determined in the second step, C and D to be displayed in the first and second regions during the second display period.

Further, in the display method, (1) a non-interlace display may be carried out in which a display of an image during a single frame period is carried out with a single scanning operation, or (2) the second display period is a second subframe constituted by an even field containing gate lines at even-numbered stages, and an interlace display is carried out in which a display of an image during a single frame period is carried out with two scanning operations on the odd-numbered stages and the even-numbered stages, respectively. No matter which of the displays is carried out, the present invention can bring about the aforementioned effects.

The liquid crystal display device or, in other words, the step of the display method may be achieved by computer. In this case, a program for causing a computer to execute the step of the display method or, in other words, a program that achieves the liquid crystal display device on a computer by causing the computer to operate as each of the means is also encompassed in the scope of the present invention. Further, a computer-readable recording medium containing such a program is also encompassed in the scope of the present invention.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

A liquid crystal display device according to the present invention is applicable to various devices that require privacy protection. More specifically, a liquid crystal display device according to the present invention is suitably applicable to portable information terminals such as cellular phones and PDAs, laptop computers, automated teller machines, electronic point of sale information management devices (EPoS), etc.

The invention claimed is:

1. A liquid crystal display device comprising:

a liquid crystal panel which exhibits different gamma curves between a time when the liquid crystal panel is looked squarely at and a time when the liquid crystal panel is looked obliquely at; and a display control circuit which divides a single frame period into a first display period and a second display period and divides a display region of the liquid crystal panel into a first region and a second region, and which causes data corresponding to different video sources to be displayed in the first region and the second region, respectively, the display control circuit having a luminance computing section which computes A to D so that A to D satisfies A+C=B+D and A≠B≠D as well as C≠B≠D, where A and C are gray-level luminances, assuming that A is the maximum luminance of an output tone with respect to an input tone of pixel data that is displayed in the first region during the first display period, that B is the maximum luminance of an output tone with respect to an input tone of pixel data that is displayed in the second region during the first display period, that C is the maximum luminance of an output tone with respect to an input tone of pixel data that is displayed in the first region during the second display period, and that D is the maximum luminance of an output tone with respect to an input tone of pixel data that is displayed in the second region during the second display period.

2. The liquid crystal display device as set forth in claim 1, wherein: A=C; and either one of B and D is a black level of luminance, and the other one of B and D is a white level of luminance.

3. The liquid crystal display device as set forth in claim 1, wherein the data that is displayed in the first region and the data that is displayed in the second region are data that constitute an image which is recognized when the liquid crystal panel is looked obliquely at.

4. A display method for dividing a single frame period into a first display period and a second display period and dividing, into a first region and a second region, a display region of a liquid crystal panel which exhibits different gamma curves between a time when the liquid crystal panel is looked squarely at and a time when the liquid crystal panel is looked obliquely at, and for causing data corresponding to different video sources to be displayed in the first region and the second region, respectively, the display method comprising the step of:

computing A to D so that A to D satisfies A+C=B+D and A≠B≠D as well as C≠B≠D, where A and C are gray-level luminances, assuming that A is the maximum luminance of an output tone with respect to an input tone of pixel data that is displayed in the first region during the first display period, that B is the maximum luminance of an output tone with respect to an input tone of pixel data that is displayed in the second region during the first display period, that C is the maximum luminance of an output tone with respect to an input tone of pixel data that is displayed in the first region during the second display period, and that D is the maximum luminance of an output tone with respect to an input tone of pixel data that is displayed in the second region during the second display period.

5. The display method as set forth in claim 4, wherein in the step, A to D are computed so that A=C, that either one of B and D is a black level of luminance, and that the other one of B and D is a white level of luminance.

6. The display method as set forth in claim 4, wherein the step includes:

a first step of determining, from the luminances of image data in the video sources which are displayed in the first and second display regions, A+C and B+D to be displayed in a total of the first and second display periods in the first and second regions, so that A+C=B+D;

a second step of determining A and B to be displayed in the first and second regions during the first display period; and a third step of calculating, from A+C and B+D as determined in the first step and A and B as determined in the second step, C and D to be displayed in the first and second regions during the second display period.

7. The display method as set forth in claim 4, wherein the data that is displayed in the first region and the data that is displayed in the second region are data that constitute an image which is recognized when the liquid crystal panel is looked obliquely at.

8. The display method as set forth in claim 4, wherein a non-interlace display is carried out in which a display of an image during a single frame period is carried out with a single scanning operation.

9. The display method as set forth in claim 4, wherein:

the first display period is a first sub-frame constituted by an odd field containing gate lines at odd-numbered stages;

the second display period is a second sub-frame constituted by an even field containing gate lines at even-numbered stages; and an interlace display is carried out in which a display of an image during a single frame period is carried out with two scanning operations on the odd-numbered stages and the even-numbered stages, respectively.

10. A non-transitory computer-readable recording medium containing a program for causing a computer to execute the steps of a display method as set forth in claim 4.

* * * * *